US011737532B2

(12) United States Patent
Dubiner

(10) Patent No.: US 11,737,532 B2
(45) Date of Patent: Aug. 29, 2023

(54) HANDBAG WITH DROP STYLE OPENING AND CUSTOM HARDWARE

(71) Applicant: Dubiner, LLC, Gainesville, FL (US)

(72) Inventor: Rachel Dubiner, Gainesville, FL (US)

(73) Assignee: Dubiner, LLC, Gainesville, FL (US)

( * ) Notice: Subject to any disclaimer, the term of this patent is extended or adjusted under 35 U.S.C. 154(b) by 0 days.

(21) Appl. No.: 15/230,027

(22) Filed: Aug. 5, 2016

(65) Prior Publication Data

US 2017/0035164 A1 Feb. 9, 2017

Related U.S. Application Data

(60) Provisional application No. 62/201,139, filed on Aug. 5, 2015.

(51) Int. Cl.

| | |
|---|---|
| ***A45C 3/06*** | (2006.01) |
| ***A45C 3/00*** | (2006.01) |
| ***A45C 13/10*** | (2006.01) |
| ***A45C 5/06*** | (2006.01) |

(52) U.S. Cl.

CPC ..... *A45C 3/06* (2013.01); *A45C 3/001* (2013.01); *A45C 5/06* (2013.01); *A45C 13/1069* (2013.01); *A45C 13/1076* (2013.01)

(58) Field of Classification Search

CPC .. A45C 3/06; A45C 3/001; A45C 5/06; A45C 13/1069; A45C 13/1076

See application file for complete search history.

(56) References Cited

U.S. PATENT DOCUMENTS

| | | | | | |
|---|---|---|---|---|---|
| 1,169,639 | A | * | 1/1916 | Hathaway | A45C 3/06 150/112 |
| 2,331,428 | A | * | 10/1943 | Selezneff | A45C 3/06 150/117 |
| 2,405,361 | A | * | 8/1946 | Langford | A45C 5/00 190/113 |
| 2,481,565 | A | * | 9/1949 | Boretz | A45C 5/00 126/261 |
| 2,562,499 | A | * | 7/1951 | Lifton | A45C 3/02 29/428 |
| 2,603,266 | A | * | 7/1952 | Carroll | A45C 3/06 150/112 |
| 2,680,460 | A | * | 6/1954 | Hyman | A45C 3/06 150/110 |

(Continued)

*Primary Examiner* — Tri M Mai

(74) *Attorney, Agent, or Firm* — FOLEY & LARDNER LLP

(57) ABSTRACT

The present invention provides a handbag with a configuration that provides an opening that allows access to the interior cavity allowing direct access to the items within the handbag. The present invention further provides an opening that allows access to the interior cavity without obstruction by handles. These advantages are provided by the handbag being formed of a material having a top portion, a bottom portion, and a body portion therebetween, where the top portion, bottom portion and body portion define an inner cavity, and the body portion includes a portal for access to the inner cavity of the handbag. An opening flap of sufficient size is used to cover the portal provided in the handbag body. The present invention further provides an inventive closing mechanism which can be used with handbags which provides a positive closing force and additional aesthetics.

17 Claims, 4 Drawing Sheets

(56) References Cited

U.S. PATENT DOCUMENTS 2,797,719 A * 7/1957 Hume ..... A45C 3/06 150/117
4,220,119 A * 9/1980 Albright ..... A01K 1/0245 119/497
4,286,639 A * 9/1981 Murphy ..... A61F 15/001 150/131
4,319,616 A * 3/1982 Light ..... A63B 55/40 206/315.2
4,515,493 A * 5/1985 Radovich ..... A45C 3/02 150/110
5,749,447 A * 5/1998 Hersh ..... A45C 3/00 190/111
6,688,470 B2 * 2/2004 Dege ..... A45C 11/20 206/545
6,722,544 B1 * 4/2004 Stephens ..... A44B 19/16 2/251
6,796,344 B2 * 9/2004 Chen ..... A45C 1/024 150/113
7,032,276 B1 * 4/2006 Olson ..... A44B 11/10 24/115 G
7,198,083 B1 * 4/2007 Sartena ..... A45C 3/06 150/118
7,344,028 B2 * 3/2008 Hanson ..... A45C 11/20 206/545
7,886,949 B2 * 2/2011 Fenton ..... A45C 7/0063 224/645
7,900,757 B2 * 3/2011 Sisitsky ..... A45C 1/024 150/113
8,156,974 B2 * 4/2012 Pace ..... A45C 3/08 150/103
8,650,723 B2 * 2/2014 Reiter ..... A44B 17/0011 24/108
8,800,737 B2 * 8/2014 Fair ..... A45C 13/02 150/112
9,078,501 B2 * 7/2015 Johnson ..... A45C 13/02
9,655,420 B2 * 5/2017 Mathews, Jr. ..... A45F 5/021
9,854,890 B2 * 1/2018 Godshaw ..... A45C 3/06
2002/0088679 A1 * 7/2002 Abraham ..... A45C 5/03 190/111
2007/0062994 A1 * 3/2007 Shoemaker ..... A45C 13/001 224/576
2013/0206527 A1 * 8/2013 Von Furstenberg ..... A45C 3/02 190/111
2014/0166704 A1 * 6/2014 Perera ..... A45F 3/04 224/153
2016/0003269 A1 * 1/2016 Russell-Clarke ..... A41F 1/002 24/303

* cited by examiner

HANDBAG WITH DROP STYLE OPENING AND CUSTOM HARDWARE

CROSS-REFERENCE TO RELATED APPLICATIONS

The present application claims priority of U.S. Provisional patent application No. 62/201,139 filed on Aug. 5, 2015 the contents of which is herein incorporated by reference.

FIELD OF INVENTION

The present invention relates to purses, backpacks, clutches or handbags. More particularly, the present invention relates to a handbag with an opening flap on the body or the side of the purse or handbag for inserting or removing items from the inner cavity of the handbag.

The present invention further relates to closing mechanisms for handbags for use to keep one surface of a handbag a fixed proximity to a second surface of a handbag or to be used in conjunction with closing a handbag having an opening flap to the body portion of the handbag.

BACKGROUND OF THE INVENTION

Handbags or purses, are widely used in today's society by both men and women to hold certain items they intend to use in their day to day activities. Common items held in handbags or purses include makeup, cellphones, hairbrushes and/or combs, wallets, gum, and keys, to name a few.

A typical handbag consists of a top portion a bottom portion and a body portion therebetween defining an inner cavity where items can be stored. The top portion of the purse provides an opening or portal to the interior cavity which is usually secured by some closing mechanism such as a hasp, or a zipper. One or more handles are typically attached to the body portion, or opposite sides of the body portion, while a strap is usually connected to one or more connection points on the top portion or one or more connection point on the body portion such that a handbag can be carried, through the use of a strap, over a user's shoulder, while keeping the handbag at approximately the waist or upper thigh of the user.

However, handbags of this construction, particularly with the opening on the top, do not provide optimal access to the contents stored within the interior cavity. As a result a user typically has to rummage through all the items in a handbag to gain access to any particular items sought in the handbag, thus disrupting any order which the items were placed in a handbag. Thus there remains an unmet need for a handbag that has an opening that allows access to the interior cavity that facilitates direct access to the items stored within without having to rummage through the items stored within the handbag.

In addition, in the configuration described above, the handles and/or straps create an obstruction to the opening or portal of the top portion, often requiring that a handbag be set down and the handles and/or strap be directed away from the top portion of the purse in order for a user to rummage through its contents to select the desired item stored within the inner cavity of the handbag. These shortcomings are purely as a result of the opening or portal to the inner cavity being located on the top portion. Thus there remains an unmet need for a handbag that has an opening that allows access to the interior cavity without obstruction by handles or straps.

Finally, typical closing mechanisms used with handbags include snaps, magnets, hasps, or zippers, to name a few. Many of these closing mechanisms are intended only for use with handbag opening on the top portion of the purse, or for small side pouches, but do not provide a positive closing force. Moreover, the typical types of closing mechanisms described above are overused, and provide little aesthetics, if any to the overall design of the handbag. Thus there remains an unmet need for a closing mechanism that provides a positive closing force between two or more surfaces of a handbag while additionally providing improved aesthetics.

No handbag exists which: provides an opening that allows access to the interior cavity that facilitates direct access to the items stored within without having to rummage through the items stored within the handbag or that has an opening that allows access to the interior cavity without obstruction by handles. In addition no closing mechanism exists that provides a positive closing force between two or more surfaces of a handbag while additionally providing improved aesthetics. Thus, there remains an unmet need.

SUMMARY OF INVENTION

The present invention overcomes the unmet needs provided above by providing a handbag formed of a material having a top portion, a bottom portion, and a body portion therebetween, where the top portion, bottom portion and body portion define an inner cavity, and the body portion includes a portal for access to the inner cavity of the handbag. The inventive handbag further includes an opening flap attached to the body portion of the handbag of sufficient size to cover the portal of the handbag, such that when the opening flap is opened away from the handbag, the handbag portal is revealed allowing access to the inner cavity of the handbag. This handbag configuration provides an opening that allows access to the interior cavity that facilitates direct access to the items stored within without having to rummage through the items stored within the handbag and has an opening that allows access to the interior cavity without obstruction by handles.

The present invention further overcomes the unmet needs discussed above in relation to closing mechanisms by providing a closing mechanism for positively closing a first surface to a second surface, which includes at least one lock base having a front side and a back side with the back side of the lock base having at least one opening, wherein the lock base is fastened to a first surface with the front side of the lock base facing toward the second surface or facing in a direction, directly or indirectly toward the second surface, a lock tab suitable for engaging the opening of the lock base, and a connection means connected to the lock tab and fastened to the second surface. The inventive closing mechanism provides a positive closing force when the lock tab is engaged with opening on the back side of the lock base, thus maintaining the first surface proximate to the second surface.

BRIEF DESCRIPTION OF THE DRAWINGS

For the present invention to be clearly understood and readily practiced, the present invention will be described in conjunction with the following figures, wherein like reference characters designate the same or similar elements, which figures are incorporated into and constitute a part of the specification, wherein:

FIG. 4A shows a side view of one embodiment of the closing mechanism when engaged. FIG. 4B shows a perspective view of the closing mechanism disengaged. FIG. 4C shows a top view of the closing mechanism when engaged.

DETAILED DESCRIPTION

The present invention provides for a handbag having an opening that allows access to the interior cavity that facilitates direct access to the items stored within without having to rummage through the items stored within the handbag and has an opening that allows access to the interior cavity without obstruction by handles. The present invention further provides an inventive closing mechanism which may be used with handbags which allows for a positive closing force when the closing mechanism is engaged between two surfaces.

The following detailed description is merely exemplary in nature and is in no way intended to limit the scope of the invention, its application, or uses, which may vary. The invention is described with relation to the non-limiting definitions and terminology included herein. These definitions and terminology are not designed to function as a limitation on the scope or practice of the invention, but are presented for illustrative and descriptive purposes only.

It is to be understood that in instances where a range of values are provided that the range is intended to encompass not only the end point values of the range but also intermediate values of the range as explicitly being included within the range and varying by the last significant figure of the range. By way of example, a recited range from 1 to 4 is intended to include 1-2, 1-3, 2-4, 3-4, and 1-4.

As used herein "handbag" may mean any purses, backpack, tote, clutch or handbag.

As used herein "closing mechanism" is intended to mean hardware for closing or fastening one surface to another surface. As used for the inventive handbag, a closing mechanism for the opening flap to the handbag body is one or more pieces of hardware that when engaged maintains the position of the opening flap relative to the handbag body and preventing items from falling out of the inner cavity of the handbag.

As used herein a "positive closing force" is intended to mean further engaging a closing mechanism where pressure outward is applied from the inner cavity. By way of example, and in no way intended to limit the invention, an inventive handbag using the inventive closing mechanism, as force outward from the inner cavity is applied the lock tab of the closing mechanism becomes more engaged with the lock base of the closing mechanism preventing inadvertent opening of the handbag.

Handbag

Figure 1:
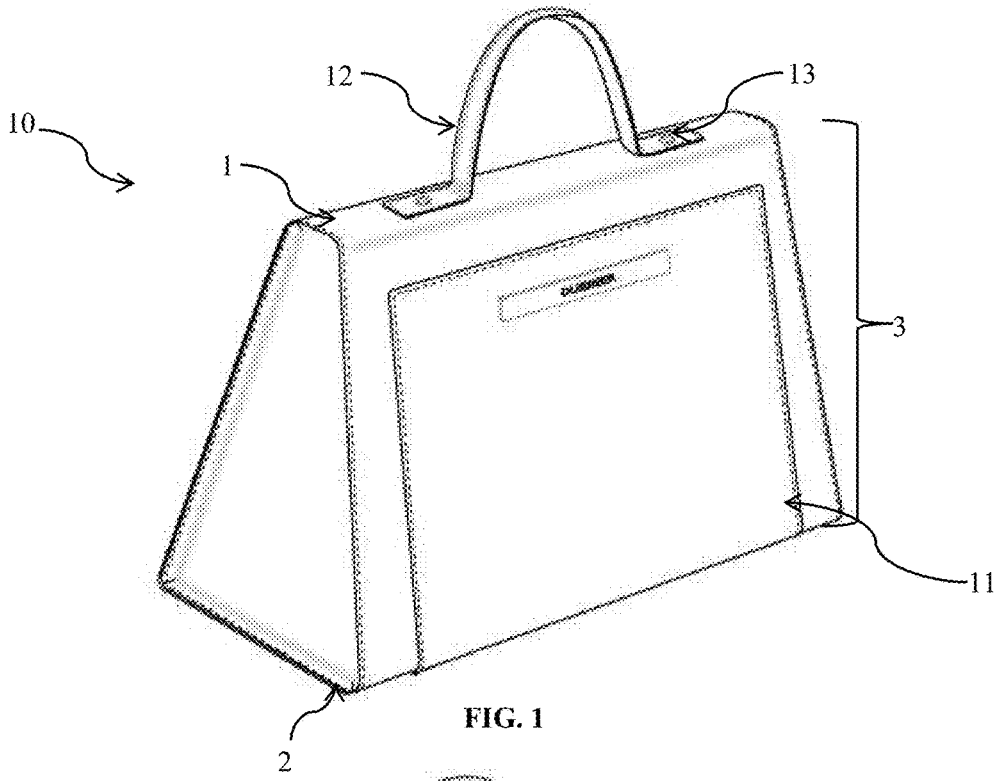
FIG. 1 is a perspective view of the inventive handbag in the closed position.

The present invention provides a handbag formed of a material having a top portion, a bottom portion, and a body portion therebetween where the top portion, bottom portion and body portion define an inner cavity. The body portion includes a portal for access to the inner cavity of the handbag. This handbag construction provides an opening that allows access to the interior cavity that facilitates direct access to the items stored within without having to rummage through the items stored within the handbag. The handbag further includes an opening flap attached to the body portion of the handbag of sufficient size to cover the portal located in the body portion of the handbag. The opening flap may alternatively be attached to the bottom portion of the handbag. In any configuration, when the opening flap is opened away from the handbag to reveal the portal in the body portion, access is provided to the inner cavity of the handbag from the body portion. In some embodiments the portal to the interior cavity on the body portion of the handbag is located on the side of the handbag relative to the top portion and the bottom portion. Many materials are known in the art for use in the construction of handbags, and nothing herein is intended to limit the materials which can be used in any embodiment of the handbag presented herein. In at least one embodiment, the handbag material is leather, faux leather, elastic, silk, burlap, suede, cotton fabric, faux fur, linen, polyester fabric, blended fabric, rayon, tapestry cloth, velvet, velveteen, batting, webbing or combinations thereof. FIG. 1 is a perspective view of the inventive 10 handbag having a 1 top portion, a 2 bottom portion and a 3 body portion which define an 4 inner cavity illustrating an 11 opening flap on the 3 body portion in the closed position which when opened allows entry to the 4 inner cavity of the 10 handbag. FIG. 1 further illustrates a 12 handle attached to the 1 top portion for carrying the 10 handbag and one or more 13 strap attachment means for optionally attaching a handbag strap (not illustrated).

In at least one embodiment, the opening flap of the handbag further includes one or more flap retainer. The primary purpose of the flap retainer is to limit the travel of the opening flap. It is appreciated that the opening flap may travel from any range from 0 to 359 degrees, however it is preferred that the opening flap be limited to be opened from 0 to 180 degrees. In at least one embodiment, the flap retainer limits the travel of the opening flap to 90 degrees relative to the portal in the body portion of the handbag. In at least one embodiment the flap retainer limits the travel of the opening flap to 45 degrees relative to the portal in the body portion of the handbag. In at least one further embodiment the flap retainer is adjustable to allow a user to define the travel of the opening flap relative to the body portion of the handbag which may be adjusted to allow the opening flap to travel between 0 and 180 degrees relative to the portal. The flap retainer may simply be a chain or lanyard connected between the opening flap and the body portion, or may be a piece of material connected between the opening flap and the body portion or a portion of the opening flap and a portion of the body portion. In at least one embodiment where the flap retainer is a chain, a leather lacing, a cord, a string, a wire, or combinations thereof. In some embodiments the flap retainer is a piece of material connected about a portion of the opening flap and about a portion of the body portion or a portion of the portal to the inner cavity. In these embodiments, the flap retainer is intended to assist in keeping the contents from spilling out of the opening flap, which may occur if only a lanyard type flap retainer is used. In at least one embodiment the flap retainer forms an expandable gusset. Several materials are known in the art which may be used as a flap retainer, and nothing herein is intended to limit the available materials used for forming the flap retainer. In at least one embodiment, the flap retainer material is leather, faux leather, elastic, silk, burlap, suede, cotton fabric, faux fur, linen, polyester fabric, blended fabric, rayon, tapestry cloth, velvet, velveteen, batting, webbing or combinations thereof.

Figure 2:
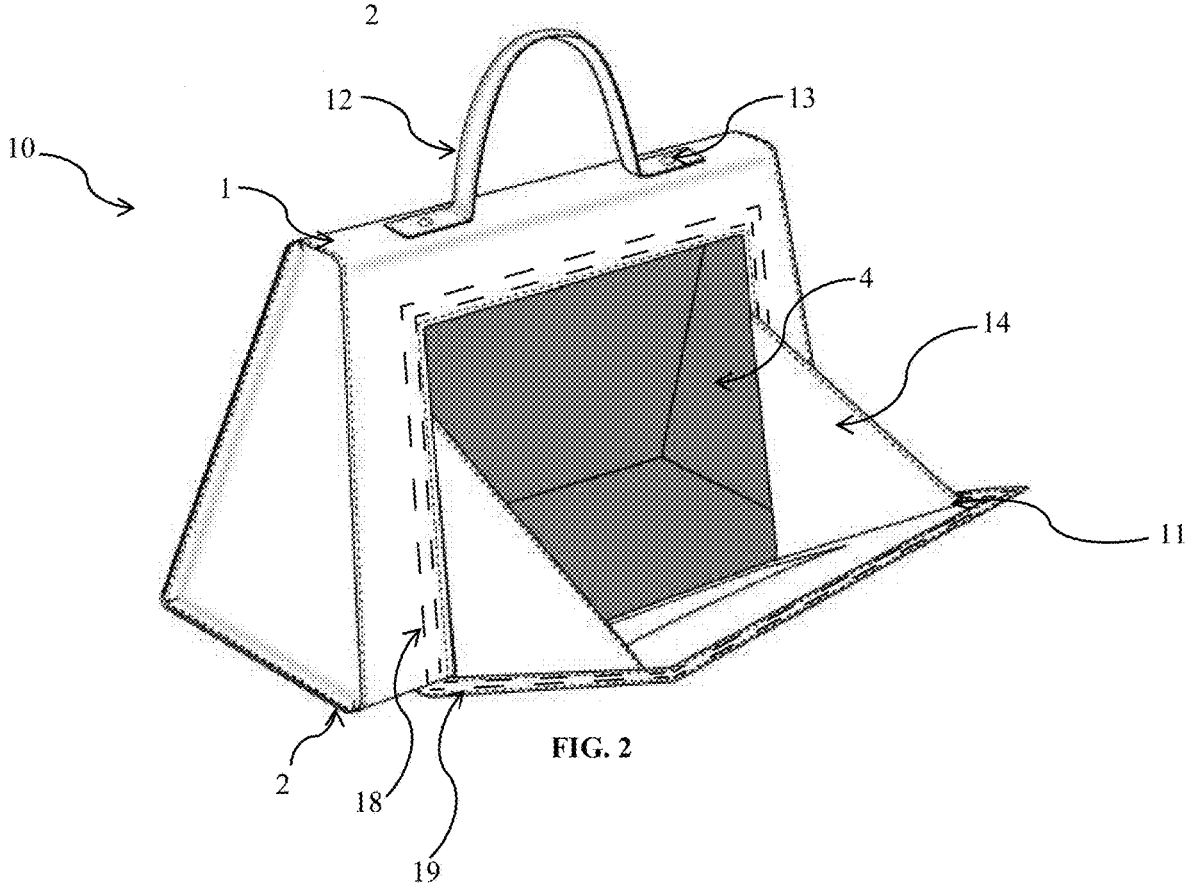
FIG. 2 is a perspective view of the inventive handbag in the open position.

FIG. 2 provides a perspective view of the inventive 10 handbag having a 1 top portion, a 2 bottom portion and a 3 body portion which define an 4 inner cavity illustrating an 11 opening flap on the 3 body portion of the handbag in the open position allowing entry to the 4 inner cavity of the 10 handbag. Further illustrated is one or more 14 flap retainers, which when included, limits the opening range of the flap and assists from keeping contents from spilling out of the 4 inner cavity to the ground. FIG. 2 further illustrates a 12 handle attached to the 1 top portion for carrying the 10 handbag and one or more 13 strap attachment means for optionally attaching a handbag strap (not illustrated).

In some embodiment the handbag body or the opening flap may include one or more pockets defined for holding general or specific items. By way of example and in no way to limit the invention, a pocket may be used for holding a cell phone, a mobile device or a tablet. In some embodiments one or more pockets may be on the interior side of the opening flap or the exterior side of the opening flap. In some embodiments the handbag body may include gussets, wherein each gusset may have one or more pockets. Material used for defining the pockets, whether in a body gusset, the opening flap or the body, may be made from many materials known in the art, and preferably those materials listed herein for the handbag or flap retainers.

It should be appreciated that other aspects of the invention are widely used in the art. While the inventive handbag may be used in any of the embodiments described above, additional aspects and features may be used, none of which is intended to limit the invention. In at least one embodiment, the inventive handbag may include a handle connected to the top portion of the handbag, one or more strap connectors for connecting one or more ends of a strap to the top portion of the handbag, at least one closing mechanism for securing the opening flap to the body portion of the handbag when said opening flap is in the closed position, and one or more feet on said body portion of the handbag. It is appreciated that typical closing mechanisms used with handbags known in the art may be used for securing the opening flap to the body to keep the opening body in the closed position. In some embodiments, the closing mechanism is a snap, magnet, hasp, zippers, or combinations thereof. In some embodiments, the opening flap or the handbag body at or near the portal may contain one or more magnets 18, 19 within the opening flap or the handbag body at or near the portal to magnetically hold the opening flap in the closed position. In some embodiments metal 18, 19 that interacts with magnets 18, 19 may be used alternately with the magnets 18, 19.

Figure 3A:
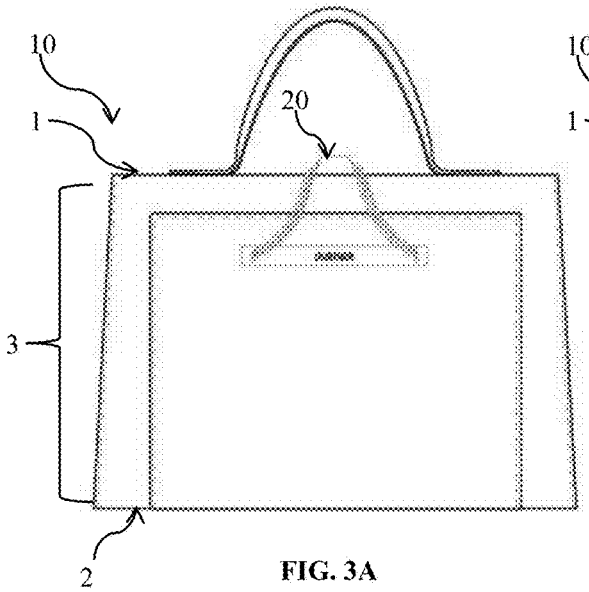
FIGS. 3A&B present a font view of the inventive handbag illustrating one embodiment of a closing mechanism in the closed position (FIG. 3A) and the open position (FIG. 3B)
Figure 3B:
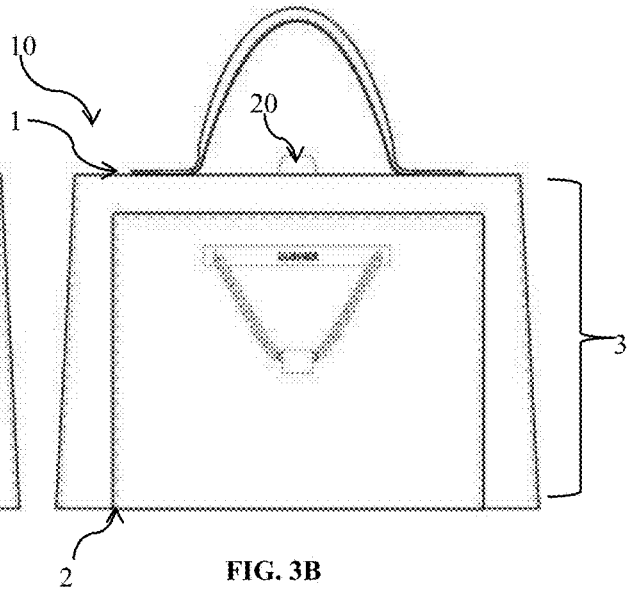
Figure 7:
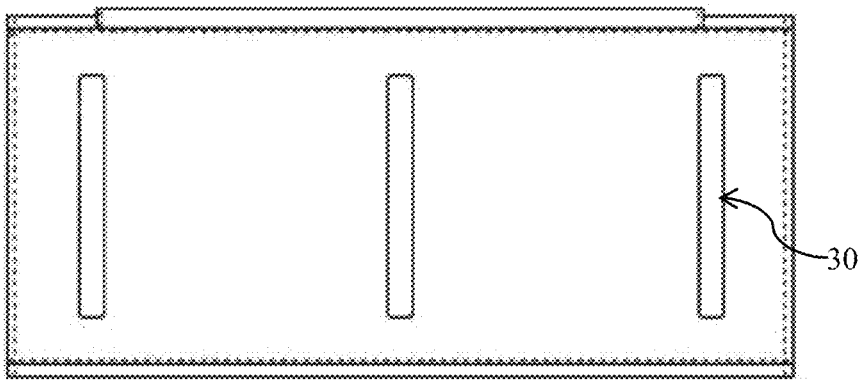
FIG. 7 presents a bottom view of the inventive handbag illustrating one or more feet on the bottom portion of the handbag.

FIGS. 3A&B present a font view of the inventive 10 handbag having a 1 top portion, a 2 bottom portion and a 3 body portion illustrating one embodiment of a 20 closing mechanism in the closed position (FIG. 3A) and the open position (FIG. 3B). FIG. 7 presents a bottom view of the inventive 10 handbag illustrating one or more 30 feet on the 2 bottom portion of the 10 handbag. Nothing herein is intended to limit the handles, strap connectors, straps, closing mechanisms or feet used in any embodiment of the handbag. Notwithstanding, some embodiments where one or more strap connectors are used, the strap connector may be one or more rings, d-rings, buckles, lobster claws, slide and loops, cam and spring buckles, snap hooks, hooks, carabiners, or combinations thereof. While there are many devices known in the art that may be used as a strap connector, nothing herein is intended to limit the selection of a strap connector and is merely provided to be exemplary in nature.

Closing Mechanism

The present invention provides a closing mechanism for positively closing a first surface to a second surface. The closing mechanism includes at least one lock base having an opening and at least one lock tab suitable for interfacing and engaging with the opening in the lock base. The lock base has a front side and a back side with the back side of the lock base including the opening. The shape of said opening on the back side of the lock base, and the shape of the lock tab is intended to be similar. Nothing herein is intended to limit the particular shape of the opening or lock tab, and any shape known in the art may be used, provided that the lock tab can be engaged with an opening in the lock base. In some embodiments, the shapes of the lock base opening and lock tab may be round, rectangular, triangular, hexangular, trapezoidal, spherical, conical, pyramidal or combinations thereof.

It is intended that the lock base is fastened to a first surface with said front side of said lock base facing, directly or indirectly, the second surface. The first or second surfaces, when intended to be fastened together by the inventive closing mechanism, may be adjacent to each other, may be separated by a collapsible portal, or may be on opposite sides of each other. When stating that the lock base facing, directly or indirectly, the second surface, it is intended that the front side of the lock base be facing the direction opposite of the closing force intended to be applied to keep the second surface proximate to the first surface. When used, the lock tab is engaged to the opening on the back side of the lock base. The lock tab and lock base may be made from any material known in the art. In at least one embodiment, the lock tab and/or lock tab are made from metal, plastic, polyvinyl chloride, wood, ceramic or combinations thereof. In some embodiments, the lock tab or the lock base contain one or more magnets for magnetically engaging the lock tab to the lock base.

In at least one embodiment a connection means is used to connect to the lock tab and the connection means is fastened to the second surface. The connection means is intended to have a length at least the distance between the back side of the lock base and the location of the connection means fastener to the second surface. The closing mechanism further includes one or more connection means connectors for connecting a connection means to a lock tab. It should be appreciated that several connection means suitable for this particular use are known in the art and nothing herein is intended to limit the selection of a particular connection means. The one or more connection means connectors is intended to provide a location for fastening or connecting a connection means to the lock tab. In at least one embodiment the one or more connection means connectors may be one or more rings, d-rings, buckles, loops, hooks, lobster laws, carabiners, or combinations thereof. The connection means may be any lanyard type connection means known in the art. Without intending to limit the present invention, a connection means suitable for the use of any embodiment herein may be a chain, a leather lacing, a cord, a string, a wire, or combinations thereof.

Figure 4A:
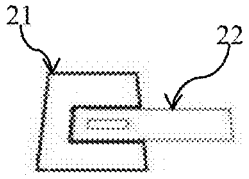
FIGS. 4A-C present an inventive handbag closing mechanism.
Figure 4B:
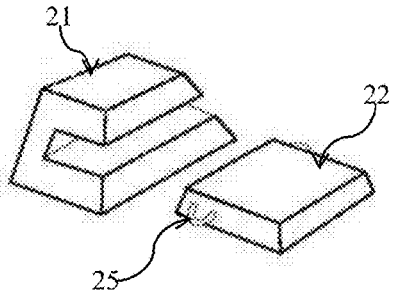
Figure 4C:
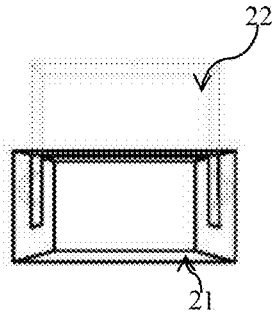

FIGS. 4A-C present the inventive handbag closing mechanism having at least one 21 lock base having an opening for receiving at least one 22 lock tab, said lock base fastened to a first surface. In some embodiments the 22 lock tab may further include one or more 25 connection means connectors for connecting a 23 connection means (see FIG. 5 and FIG. 6) allowing the 22 lock tab to be secured to a second surface. FIG. 4A shows a side view of one embodiment of the 22 lock tab engaged to one embodiment of the 21 lock base. FIG. 4B shows a perspective view of one embodiment of the 22 lock tab disengaged from one embodiment of the 21 lock base and further illustrating one or more optional 25 connection means connectors on the 22 lock tab. FIG. 4C shows a top view of one embodiment of the 22 lock tab engaged to one embodiment of the 21 lock base.

Handbag with Inventive Closing Mechanism

The present invention finally provides for a handbag as described in any of the embodiments provided for herein, using any embodiment of the closing mechanism provided for above. When the inventive closing mechanism is used in conjunction with the inventive handbag, a nameplate may be used for fastening the connection means to the opening flap, and the lock base may be attached to the top portion of the handbag.

Figure 5:
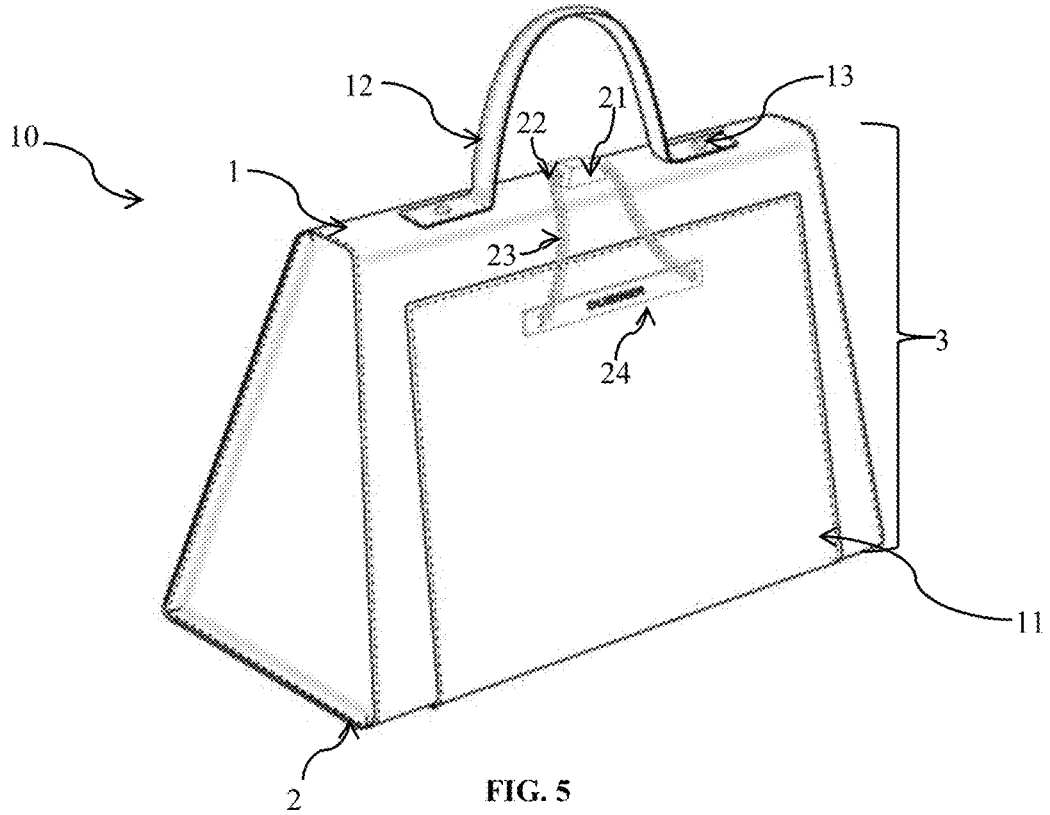
FIG. 5 is a perspective view of the inventive handbag in the closed position illustrating the use of the inventive closing mechanism when engaged.

FIG. 5 is a perspective view of the inventive 10 handbag having a 1 top portion, a 2 bottom portion and a 3 body portion which define an 4 inner cavity illustrating an 11 opening flap having a 24 nameplate connected to a 22 lock tab by a 23 connection means, where the 22 lock tab is engaged with the 21 lock base securing the 11 opening flap on the 3 body portion of the 10 handbag in the closed position which when opened allows entry to the 4 inner cavity of the 10 handbag. FIG. 5 further illustrates a 12 handle attached to the 1 top portion for carrying the 10 handbag and one or more 13 strap attachment means for optionally attaching a handbag strap (not illustrated).

Figure 6:
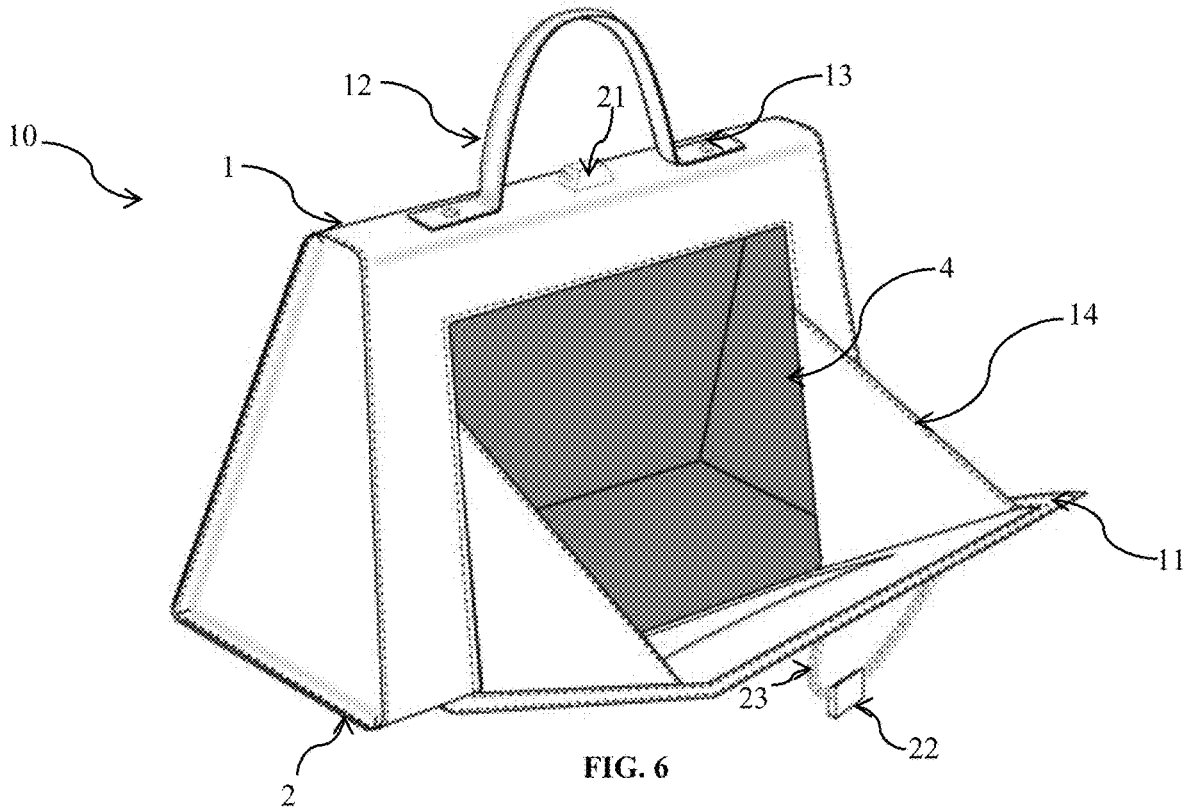
FIG. 6 is a perspective view of the inventive handbag in the open position illustrating the use of the inventive closing mechanism when disengaged.

FIG. 6 is a perspective view of the inventive 10 handbag having a 1 top portion, a 2 bottom portion and a 3 body portion which define an 4 inner cavity illustrating an 11 opening flap having a 24 nameplate (not shown) connected to a 22 lock tab by a 23 connection means, where the 22 lock tab is disengaged from the 21 lock base for allowing the 11 opening flap on the 3 body portion of the 10 handbag to be open allowing entry to the 4 inner cavity of the 10 handbag. Further illustrated is one or more 14 flap retainers, which when included, limits the opening range of the 11 opening flap and assists from keeping contents from spilling out of the 4 inner cavity to the ground. FIG. 6 further illustrates a 12 handle attached to the 1 top portion for carrying the 10 handbag and one or more 13 strap attachment means for optionally attaching a handbag strap (not illustrated).

EXAMPLES

It is to be understood that while the invention has been described in conjunction with the detailed description thereof, the foregoing description is intended to illustrate and not limit the scope of the invention, which is defined by the scope of the appended claims. Other aspects, advantages, and modifications are within the scope of the following claims.

Example 1

A handbag of FIG. 1 and FIG. 2 is provided. The handbag includes a 1 top portion, a 2 bottom portion and a 3 body portion which define an 4 inner cavity. The 3 body portion of the handbag has a portal to provide access to the 4 inner cavity. The 10 handbag further includes an 11 opening flap suitable for covering the portal of the 3 body portion. The handbag further includes a 12 handle attached to the 1 top portion for carrying the 10 handbag and one or more 13 strap attachment means for optionally attaching a handbag strap (not illustrated). When used, various items are stored in the 4 inner cavity of the 10 handbag with the 11 opening flap being closed by covering the portal in the 3 body portion of the 10 handbag. Access to the items stored in the 4 inner cavity is granted by opening the 11 opening flap away from the 3 body portion of the 10 handbag to reveal the portal in the 3 body portion of the 10 handbag.

Example 2

A closing mechanism of FIGS. 4A-C is provided which includes a 21 lock base having an opening for receiving a 22 lock tab, wherein the lock base is connected to a first surface. The 22 lock tab includes two 25 connection means connectors to be used for connecting a connection means (not illustrated) to the lock tab allowing the 22 lock tab to be secured to a second surface. The 22 lock tab engages with the 21 lock base which when used with a connection means, allows the first surface having the 21 lock base to be secured within proximity of a second surface connected to the 22 lock tab through the use of the connection means connected to the second surface.

Example 3

An inventive handbag using an inventive closing mechanism is provided in FIG. 5 and FIG. 6. The handbag includes a 1 top portion, a 2 bottom portion and a 3 body portion which define an 4 inner cavity. The 3 body portion of the handbag has a portal to provide access to the 4 inner cavity. The 1 top portion has a 21 lock base fastened to it. The 10 handbag further includes an 11 opening flap suitable for covering the portal of the 3 body portion. The 11 opening flap has a 24 nameplate connected to a 22 lock tab by a 23 connection means. The handbag further includes a 12 handle attached to the 1 top portion for carrying the 10 handbag and one or more 13 strap attachment means for optionally attaching a handbag strap (not illustrated). When used, various items are stored in the 4 inner cavity of the 10 handbag with the 11 opening flap being closed by covering the portal in the 3 body portion of the 10 handbag. In the closed position, the 22 lock tab is engaged with the 21 lock base securing the 11 opening flap on the 3 body portion of the 10 handbag in the closed position. Access to the items stored in the 4 inner cavity is granted by first disengaging the 22 lock tab from the 21 lock base opening then opening the 11 opening flap away from the 3 body portion of the 10 handbag to reveal the portal in the 3 body portion of the 10 handbag.

Other Embodiments

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the described embodiments in any way. Rather, the foregoing detailed description will provide those skilled in the art with a convenient road map for implementing the exemplary embodiment or exemplary embodiments. It should be understood that various changes can be made in the function and arrangement of elements without departing from the scope as set forth in the appended claims and the legal equivalents thereof.

The invention claimed is:

1. A handbag comprising:

a top portion;

a bottom portion opposite the top portion;

a body portion cooperating with the top portion and the bottom portion to define an inner cavity and comprising a first side contiguous with the top portion and the bottom portion;

a portal disposed in the first side and providing access into the inner cavity through the first side and access out of the inner cavity through the first side, the portal comprising:

a first portal side;

a second portal side contiguous with the first portal side;

a third portal side contiguous with the second portal side; and a fourth portal side contiguous with the first portal side and the third portal side;

an opening flap operable between an open position where access into the inner cavity through the portal is permitted and a closed position where access into the inner cavity through the portal is prohibited, the opening flap comprising:

an opening flap inner surface;

a first opening flap side;

a second opening flap side contiguous with the first opening flap side;

a third opening flap side contiguous with the second opening flap side; and a fourth opening flap side contiguous with the first opening flap side and the third opening flap side;

a first flap retainer coupled to the opening flap inner surface and the first side along the first portal side; and a second flap retainer coupled to the opening flap inner surface and the first side along the third portal side;

wherein the top portion, the bottom portion, the body portion, and the opening flap cooperate to enclose the inner cavity when the opening flap is in the closed position;

wherein the opening flap overlaps a first portion of the first side along the first portal side, the second portal side, and the third portal side when the opening flap is in the closed position;

wherein the opening flap does not overlap a second portion of the first side when the opening flap is in the closed position;

wherein the second portion extends along the first portal side, the second portal side, and the third portal side;

wherein the first flap retainer and the second flap retainer are coupled to the opening flap inner surface such that a portion of the opening flap inner surface contiguous with the first opening flap side, the second opening flap side, and the third opening flap side overlaps the first portion when the opening flap is in the closed position; and wherein the body portion further comprises:

a second side contiguous with the top portion and contiguous with the bottom portion;

a third side contiguous with the top portion, the bottom portion, the first side, and the second side; and a fourth side contiguous with the top portion opposite the third side, contiguous with the bottom portion opposite the third side, contiguous with the first side, and contiguous with the second side.

2. The handbag of claim 1, wherein:

the first portal side is parallel to the third portal side;

the third portal side is orthogonal to the second portal side;

the fourth portal side is parallel to the second portal side; and the opening flap is coupled to the bottom portion.

3. The handbag of claim 1, further comprising a handle coupled to the top portion and separate from the opening flap;

wherein the handle is coupled to the top portion such that the handle does not obstruct the portal when the opening flap is in the open position.

4. The handbag of claim 1, wherein:

the bottom portion has a substantially constant first width from the first side to the second side;

the top portion has a substantially constant second width from the first side to the second side; and the first width is greater than the second width.

5. The handbag of claim 1, wherein:

the top portion, the bottom portion, the body portion, and the opening flap substantially form an isosceles trapezoid along a plane bisecting the body portion, the top portion, and the bottom portion, when the opening flap is in the closed position; and the first portion and the second portion are coplanar.

6. The handbag of claim 1, further comprising:

a lock base coupled to the top portion;

a connector coupled to the opening flap; and a lock tab coupled to the connector and configured to be coupled to the lock base to retain the opening flap relative to the top portion.

7. The handbag of claim 1, wherein the opening flap traverses an angular distance of less than or equal to 90 degrees between the open position and the closed position.

8. The handbag of claim 7, wherein the opening flap traverses an angular distance of greater than or equal to 45 degrees between the open position and the closed position.

9. A handbag comprising:

a top portion;

a bottom portion opposite the top portion;

a body portion cooperating with the top portion and the bottom portion to define an inner cavity and comprising:

a first side contiguous with the top portion and the bottom portion;

a second side contiguous with the top portion opposite the first side and contiguous with the bottom portion opposite the first side;

a third side contiguous with the top portion, the bottom portion, the first side, and the second side; and a fourth side contiguous with the top portion opposite the third side, contiguous with the bottom portion opposite the third side, contiguous with the first side, and contiguous with the second side;

a portal disposed in the first side and providing access into the inner cavity through the first side and access out of the inner cavity through the first side, the portal comprising:

a first portal side;

a second portal side contiguous with the first portal side;

a third portal side contiguous with the second portal side; and a fourth portal side contiguous with the first portal side and the third portal side;

an opening flap coupled to the bottom portion and operable between an open position where the portal is uncovered and a closed position where the portal is covered, the opening flap comprising:

an opening flap inner surface;

a first opening flap side;

a second opening flap side contiguous with the first opening flap side;

a third opening flap side contiguous with the second opening flap side; and a fourth opening flap side contiguous with the first opening flap side and the third opening flap side;

a first flap retainer coupled to the opening flap inner surface and the first side along the first portal side; and a second flap retainer coupled to the opening flap inner surface and the first side along the third portal side;

wherein the opening flap covers a first portion of the first side along the first portal side, the second portal side, and the third portal side when the opening flap is in the closed position;

wherein a second portion of the first side remains uncovered when the opening flap is in the closed position;

wherein the first portion and the second portion are coplanar;

wherein the top portion, the bottom portion, the body portion, and the opening flap cooperate to enclose the inner cavity when the opening flap is in the closed position;

wherein the second portion extends along the first portal side, the second portal side, and the third portal side;

wherein the first flap retainer and the second flap retainer are coupled to the opening flap inner surface such that a portion of the opening flap inner surface contiguous with the first opening flap side, the second opening flap side, and the third opening flap side overlaps the first portion when the opening flap is in the closed position; and wherein the top portion, the bottom portion, the body portion, and the opening flap substantially form an isosceles trapezoid along a plane bisecting the body portion, the top portion, and the bottom portion, when the opening flap is in the closed position.

10. A purse comprising:

a top portion;

a bottom portion opposite the top portion;

a body portion cooperating with the top portion and the bottom portion to define an inner cavity of the purse, the body portion comprising:

a first side contiguous with the top portion and the bottom portion;

a second side contiguous with the top portion opposite the first side and contiguous with the bottom portion opposite the first side;

a third side contiguous with the top portion, the bottom portion, the first side, and the second side; and a fourth side contiguous with the top portion opposite the third side, contiguous with the bottom portion opposite the third side, contiguous with the first side, and contiguous with the second side;

a portal disposed in the first side and providing access into the inner cavity through the first side and access out of the inner cavity through the first side, the portal comprising:

a first portal side;

a second portal side contiguous with the first portal side;

a third portal side contiguous with the second portal side; and a fourth portal side contiguous with the first portal side and the third portal side;

an opening flap operable between an open position where access into the inner cavity through the portal is permitted and a closed position where access into the inner cavity through the portal is prohibited, the opening flap comprising:

an opening flap inner surface;

a first opening flap side;

a second opening flap side contiguous with the first opening flap side;

a third opening flap side contiguous with the second opening flap side; and a fourth opening flap side contiguous with the first opening flap side and the third opening flap side;

a first flap retainer coupled to the opening flap inner surface and the first side along the first portal side; and a second flap retainer coupled to the opening flap inner surface and the first side along the third portal side;

wherein the top portion, the bottom portion, the body portion, and the opening flap cooperate to define a shape of the purse and enclose the inner cavity when the opening flap is in the closed position;

wherein the opening flap overlaps a first portion of the first side along the first portal side, the second portal side, and the third portal side when the opening flap is in the closed position;

wherein the opening flap does not overlap a second portion of the first side when the opening flap is in the closed position;

wherein the second portion extends along the first portal side, the second portal side, and the third portal side;

wherein the first flap retainer and the second flap retainer are coupled to the opening flap inner surface such that a portion of the opening flap inner surface contiguous with the first opening flap side, the second opening flap side, and the third opening flap side overlaps the first portion when the opening flap is in the closed position; and wherein the top portion, the bottom portion, the body portion, and the opening flap substantially form an isosceles trapezoid along a plane bisecting the body portion, the top portion, and the bottom portion, when the opening flap is in the closed position.

11. The purse of claim 10, wherein the first portion and the second portion are coplanar.

12. The purse of claim 11, wherein the opening flap is pivotably coupled to the bottom portion.

13. The purse of claim 10, further comprising a handle coupled to the top portion and separate from the opening flap;

wherein the handle is coupled to the top portion such that the handle does not obstruct the portal when the opening flap is in the open position.

14. The purse of claim 10, further comprising:

a first magnetic member contained within the opening flap; and a second magnetic member contained within the first portion;

wherein the second magnetic member is configured to cooperate with the first magnetic member to retain the opening flap in the closed position.

15. A handbag comprising:

a top portion;

a bottom portion opposite the top portion;

a body portion cooperating with the top portion and the bottom portion to define an inner cavity and comprising a first side contiguous with the top portion and the bottom portion;

a portal disposed in the first side and providing access into the inner cavity through the first side and access out of the inner cavity through the first side, the portal comprising:

a first portal side;

a second portal side contiguous with the first portal side;

a third portal side contiguous with the second portal side; and a fourth portal side contiguous with the first portal side and the third portal side;

an opening flap operable between an open position where access into the inner cavity through the portal is permitted and a closed position where access into the inner cavity through the portal is prohibited, the opening flap comprising:

an opening flap inner surface;

a first opening flap side;

a second opening flap side contiguous with the first opening flap side;

a third opening flap side contiguous with the second opening flap side; and a fourth opening flap side contiguous with the first opening flap side and the third opening flap side;

a first flap retainer coupled to the opening flap inner surface and the first side along the first portal side; and a second flap retainer coupled to the opening flap inner surface and the first side along the third portal side;

wherein the top portion, the bottom portion, the body portion, and the opening flap cooperate to enclose the inner cavity when the opening flap is in the closed position;

wherein the opening flap overlaps a first portion of the first side along the first portal side, the second portal side, and the third portal side when the opening flap is in the closed position;

wherein the opening flap does not overlap a second portion of the first side when the opening flap is in the closed position;

wherein the second portion extends along the first portal side, the second portal side, and the third portal side;

wherein the first flap retainer and the second flap retainer are coupled to the opening flap inner surface such that a portion of the opening flap inner surface contiguous with the first opening flap side, the second opening flap side, and the third opening flap side overlaps the first portion when the opening flap is in the closed position;

wherein the top portion, the bottom portion, the body portion, and the opening flap substantially form an isosceles trapezoid along a plane bisecting the body portion, the top portion, and the bottom portion, when the opening flap is in the closed position; and wherein the first portion and the second portion are coplanar.

16. A handbag comprising:

a top portion;

a bottom portion opposite the top portion;

a body portion cooperating with the top portion and the bottom portion to define an inner cavity and comprising a first side contiguous with the top portion and the bottom portion;

a portal disposed in the first side and providing access into the inner cavity through the first side and access out of the inner cavity through the first side, the portal comprising:

a first portal side;

a second portal side contiguous with the first portal side;

a third portal side contiguous with the second portal side; and a fourth portal side contiguous with the first portal side and the third portal side;

an opening flap operable between an open position where access into the inner cavity through the portal is permitted and a closed position where access into the inner cavity through the portal is prohibited, the opening flap comprising:

an opening flap inner surface;

a first opening flap side;

a second opening flap side contiguous with the first opening flap side;

a third opening flap side contiguous with the second opening flap side; and a fourth opening flap side contiguous with the first opening flap side and the third opening flap side;

a first flap retainer coupled to the opening flap inner surface and the first side along the first portal side;

a second flap retainer coupled to the opening flap inner surface and the first side along the third portal side;

a lock base coupled to the top portion;

a connector coupled to the opening flap; and a lock tab coupled to the connector and configured to be coupled to the lock base to retain the opening flap relative to the top portion;

wherein the top portion, the bottom portion, the body portion, and the opening flap cooperate to enclose the inner cavity when the opening flap is in the closed position;

wherein the opening flap overlaps a first portion of the first side along the first portal side, the second portal side, and the third portal side when the opening flap is in the closed position;

wherein the opening flap does not overlap a second portion of the first side when the opening flap is in the closed position;

wherein the second portion extends along the first portal side, the second portal side, and the third portal side; and wherein the first flap retainer and the second flap retainer are coupled to the opening flap inner surface such that a portion of the opening flap inner surface contiguous with the first opening flap side, the second opening flap side, and the third opening flap side overlaps the first portion when the opening flap is in the closed position.

17. A purse comprising:

a top portion;

a bottom portion opposite the top portion;

a body portion cooperating with the top portion and the bottom portion to define an inner cavity of the purse, the body portion comprising:

a first side contiguous with the top portion and the bottom portion;

a second side contiguous with the top portion opposite the first side and contiguous with the bottom portion opposite the first side;

a third side contiguous with the top portion, the bottom portion, the first side, and the second side; and a fourth side contiguous with the top portion opposite the third side, contiguous with the bottom portion opposite the third side, contiguous with the first side, and contiguous with the second side;

a portal disposed in the first side and providing access into the inner cavity through the first side and access out of the inner cavity through the first side, the portal comprising:

a first portal side;

a second portal side contiguous with the first portal side;

a third portal side contiguous with the second portal side; and a fourth portal side contiguous with the first portal side and the third portal side;

an opening flap operable between an open position where access into the inner cavity through the portal is permitted and a closed position where access into the inner cavity through the portal is prohibited, the opening flap comprising:

an opening flap inner surface;

a first opening flap side;

a second opening flap side contiguous with the first opening flap side;

a third opening flap side contiguous with the second opening flap side; and a fourth opening flap side contiguous with the first opening flap side and the third opening flap side;

a first flap retainer coupled to the opening flap inner surface and the first side along the first portal side;

a second flap retainer coupled to the opening flap inner surface and the first side along the third portal side;

a first magnetic member contained within the opening flap; and a second magnetic member;

wherein the top portion, the bottom portion, the body portion, and the opening flap cooperate to define a shape of the purse and enclose the inner cavity when the opening flap is in the closed position;

wherein the opening flap overlaps a first portion of the first side along the first portal side, the second portal side, and the third portal side when the opening flap is in the closed position;

wherein the opening flap does not overlap a second portion of the first side when the opening flap is in the closed position;

wherein the second portion extends along the first portal side, the second portal side, and the third portal side;

wherein the first flap retainer and the second flap retainer are coupled to the opening flap inner surface such that a portion of the opening flap inner surface contiguous with the first opening flap side, the second opening flap side, and the third opening flap side overlaps the first portion when the opening flap is in the closed position;

wherein the second magnetic member is configured to cooperate with the first magnetic member to retain the opening flap in the closed position; and wherein the second magnetic member is contained within the first portion.

* * * * *